US011287207B2

(12) United States Patent
DeJessa

(10) Patent No.: US 11,287,207 B2
(45) **Date of Patent: *Mar. 29, 2022**

(54) INERTIAL DECOUPLER FOR FIREARM SOUND SUPPRESSOR

(71) Applicant: Smith & Wesson Inc., Springfield, MA (US)

(72) Inventor: Joseph DeJessa, West Brookfield, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/181,457

(22) Filed: Feb. 22, 2021

(65) Prior Publication Data

US 2021/0270558 A1 Sep. 2, 2021

Related U.S. Application Data

(63) Continuation of application No. 16/596,577, filed on Oct. 8, 2019, now Pat. No. 10,969,187.

(60) Provisional application No. 62/743,398, filed on Oct. 9, 2018.

(51) Int. Cl.

| | |
|---|---|
| ***F41A 21/32*** | (2006.01) |
| ***F41A 21/30*** | (2006.01) |
| *F41A 21/36* | (2006.01) |

(52) U.S. Cl.

CPC ..... *F41A 21/30* (2013.01); *F41A 21/325* (2013.01); *F41A 21/36* (2013.01)

(58) Field of Classification Search

CPC ..... F41A 21/30

See application file for complete search history.

(56) References Cited

U.S. PATENT DOCUMENTS

| | | | | |
|---|---|---|---|---|
| 2,191,484 A | | 2/1940 | Hughes | |
| 2,759,286 A | * | 8/1956 | Moore | F41A 21/42 42/79 |
| 2,847,788 A | * | 8/1958 | Twigg | F41A 21/42 42/79 |
| 2,883,782 A | * | 4/1959 | Schroeder | F41A 21/42 42/79 |
| 2,894,348 A | * | 7/1959 | Cutts | F41A 21/42 42/79 |
| 3,156,061 A | * | 11/1964 | Evans | F41A 21/42 42/79 |
| 3,797,155 A | * | 3/1974 | Smith | F41A 21/42 42/79 |
| 3,867,778 A | * | 2/1975 | Preda | F41A 21/40 42/79 |

(Continued)

OTHER PUBLICATIONS

Operational Manual for Sound Suppressor Model Trinity (9mm), Manufactured by Gemtech, Sep. 16, 2006, 16 pages.

*Primary Examiner* — Derrick R Morgan
(74) *Attorney, Agent, or Firm* — Stinson LLP

(57) ABSTRACT

An inertial decoupler and suppressor assembly, associated components, and associated methods. The inertial decoupler is adjustable to change a preload of a spring biasing a piston toward an at-rest position and/or to change a permitted travel distance of the piston away from the at-rest position. The inertial decoupler can be removable from the suppressor and usable with other suppressors, or can be integrated with a dedicated suppressor.

18 Claims, 12 Drawing Sheets

(56) References Cited

U.S. PATENT DOCUMENTS 4,384,507 A * 5/1983 Finn ..... F41A 21/30 181/241
4,972,760 A 11/1990 McDonnell
5,279,200 A * 1/1994 Rose ..... F41A 21/32 89/14.3
5,559,302 A * 9/1996 Latka ..... F41A 21/325 89/14.05
5,814,757 A * 9/1998 Buss ..... F41A 21/36 89/14.3
7,493,845 B2 2/2009 Mantas
7,588,122 B2 * 9/2009 Brittingham ..... F41A 21/30 181/223
8,186,261 B2 5/2012 McNeill et al.
8,272,306 B1 * 9/2012 Smith ..... F41A 21/30 89/14.4
8,387,299 B1 * 3/2013 Brittingham ..... F41A 21/325 42/90
8,857,306 B1 10/2014 Edsall
8,910,558 B2 12/2014 Kent
9,631,888 B2 4/2017 Young
9,739,560 B1 * 8/2017 Salvador ..... F41A 21/325
9,921,021 B1 3/2018 Graham, II
9,958,227 B2 5/2018 Whitson
10,048,033 B1 * 8/2018 Lee ..... F41A 21/34
10,184,744 B2 * 1/2019 Young ..... F41A 21/325
10,184,745 B1 * 1/2019 Fulton ..... F41A 21/30
10,281,228 B1 * 5/2019 Marfione ..... F41A 21/30
10,605,558 B1 * 3/2020 Marfione ..... F41A 21/30
10,619,962 B1 * 4/2020 Hatfield ..... F41A 21/44
2009/0050403 A1 * 2/2009 Brittingham ..... F41A 21/30 181/223
2011/0088540 A1 * 4/2011 Brittingham ..... F41A 21/30 89/14.5
2015/0253098 A1 * 9/2015 Russell ..... F41A 21/30 89/14.4
2017/0205176 A1 * 7/2017 Whitson ..... F41A 21/325
2017/0307322 A1 * 10/2017 Davis ..... F41A 21/30
2017/0336165 A1 11/2017 Wirth
2018/0106569 A1 * 4/2018 Smith ..... F41A 21/30
2018/0120045 A1 * 5/2018 Rost ..... F41A 21/34
2018/0292164 A1 * 10/2018 Thompson ..... F41A 21/36
2019/0353446 A1 * 11/2019 Kras ..... F41A 21/325
2020/0248980 A1 * 8/2020 Bragais ..... F41A 21/32

* cited by examiner

INERTIAL DECOUPLER FOR FIREARM SOUND SUPPRESSOR

CROSS-REFERENCE TO RELATED APPLICATION

The present application is a continuation application which claims priority to U.S. patent application Ser. No. 16/596,577 filed Oct. 8, 2019, which claims priority to U.S. Patent Application No. 62/743,398, filed Oct. 9, 2018, the entirety of which is hereby incorporated by reference.

FIELD

The present disclosure generally relates to firearms accessories, and more particularly to an inertial decoupler for a firearm sound suppressor.

BACKGROUND

A suppressor mounted on a barrel of a pistol can cause the pistol to not cycle properly after being fired. The mass of the suppressor can increase the effective mass of the barrel such that the barrel does not move properly to cycle the pistol. To overcome this side effect, suppressors mounted on pistols often include an inertial decoupling device called a Nielsen device, booster, or linear inertial decoupler or damper (LID). Such devices temporarily "decouple" the mass of the suppressor from the barrel when the pistol is fired. Accordingly, the pistol is permitted to cycle properly notwithstanding the mass of the suppressor mounted on the barrel.

SUMMARY

In one aspect, an inertial decoupler for connecting a firearm sound suppressor to a firearm comprises a housing having a housing proximal end and a housing distal end. The housing is sized and shaped to permit a projectile fired from the firearm to pass the housing from the housing proximal end to the housing distal end when the inertial decoupler is connected to the firearm. A spring is supported by the housing. A piston is supported by the housing and includes a piston proximal end and a piston distal end. The piston defines a piston passage configured to permit a projectile fired from the firearm to pass from the piston proximal end to the piston distal end along a projectile axis along the piston passage when the inertial decoupler is connected to the firearm. The piston is biased distally by the spring toward an at-rest position of the piston with respect to the housing. The piston defines a first spring engagement surface against which the spring bears to bias the piston toward the at-rest position. The piston is movable proximally with respect to the housing away from the at-rest position to deflect the spring responsive to firing of the firearm for temporarily decoupling the firearm sound suppressor from the firearm. A spring retainer defines a second spring engagement surface against which the spring bears to bias the piston distally with respect to the housing. The spring retainer is configurable in a first preset position with respect to the piston and a second preset position with respect to the piston to change a distance between the first and second spring engagement surfaces when the piston is in the at-rest position. When the spring retainer is in the first preset position and the piston is in the at-rest position, the spring has a first spring preload. When the spring retainer is in the second preset position and the piston is in the at-rest position, the spring has a second spring preload different than the first spring preload.

In another aspect, an inertial decoupler for connecting a firearm sound suppressor to a firearm. The inertial decoupler comprises a housing having a housing proximal end and a housing distal end. The housing is sized and shaped to permit a projectile fired from the firearm to pass the housing from the housing proximal end to the housing distal end when the inertial decoupler is connected to the firearm. A spring is supported by the housing. The inertial decoupler includes a piston supported by the housing. The piston includes a piston proximal end and a piston distal end. The piston defines a piston passage configured to permit a projectile fired from the firearm to pass from the piston proximal end to the piston distal end along a projectile axis along the piston passage when the inertial decoupler is connected to the firearm. The piston is biased distally by the spring toward an at-rest position of the piston with respect to the housing, the piston defining a first spring engagement surface against which the spring bears to bias the piston toward the at-rest position. The piston is movable proximally with respect to the housing away from the at-rest position to deflect the spring responsive to firing of the firearm for temporarily decoupling the firearm sound suppressor from the firearm. A stop is configured to engage the piston to limit piston travel with respect to the housing away from the at-rest position. The stop is configurable in first and second positions. The stop in the first position permits a first maximum distance of piston travel proximally from the at-rest position. The stop in the second position permits a second maximum distance of piston travel proximally from the at-rest position. The second maximum distance of piston travel is different than the first maximum distance of piston travel.

In yet another aspect, a method of adjusting an inertial decoupler for a firearm sound suppressor comprises selecting a specific firearm for use with the inertial decoupler, and changing a decoupling performance characteristic of the inertial decoupler to provide a decoupling performance of the inertial decoupler for the specific firearm.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
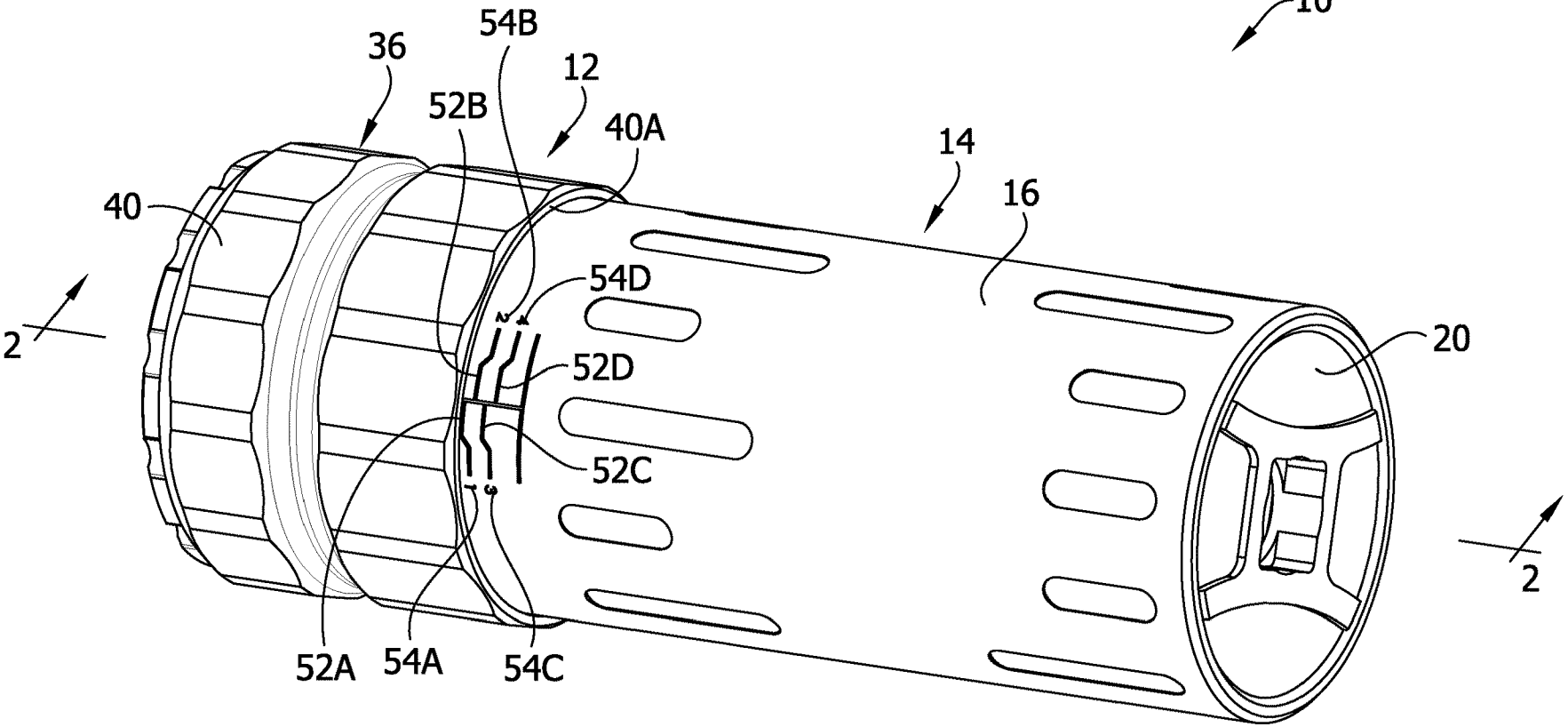
FIG. 1 is a perspective of an assembly including an inertial decoupler and a sound suppressor of the present disclosure, the inertial decoupler shown in a first preset configuration.

Referring to FIG. 1, an assembly 10 includes an inertial decoupler 12 and firearm sound suppressor 14. The inertial decoupler 12 (broadly, "suppressor connector") can be used to connect the sound suppressor 14 to a barrel of a firearm (e.g., a pistol). The inertial decoupler 12 is configured to temporarily "decouple" the sound suppressor 14 from the barrel responsive to a shot being fired so the suppressor does not adversely affect proper cycling of the pistol. As will become apparent, the inertial decoupler 12 is adjustable to change a preload of a spring and/or to change a maximum permitted travel distance of a piston of the inertial decoupler such that the inertial decoupler can be configured for use with various firearms, suppressors, and/or ammunitions, and to suit the preference of different users.

Figure 2:
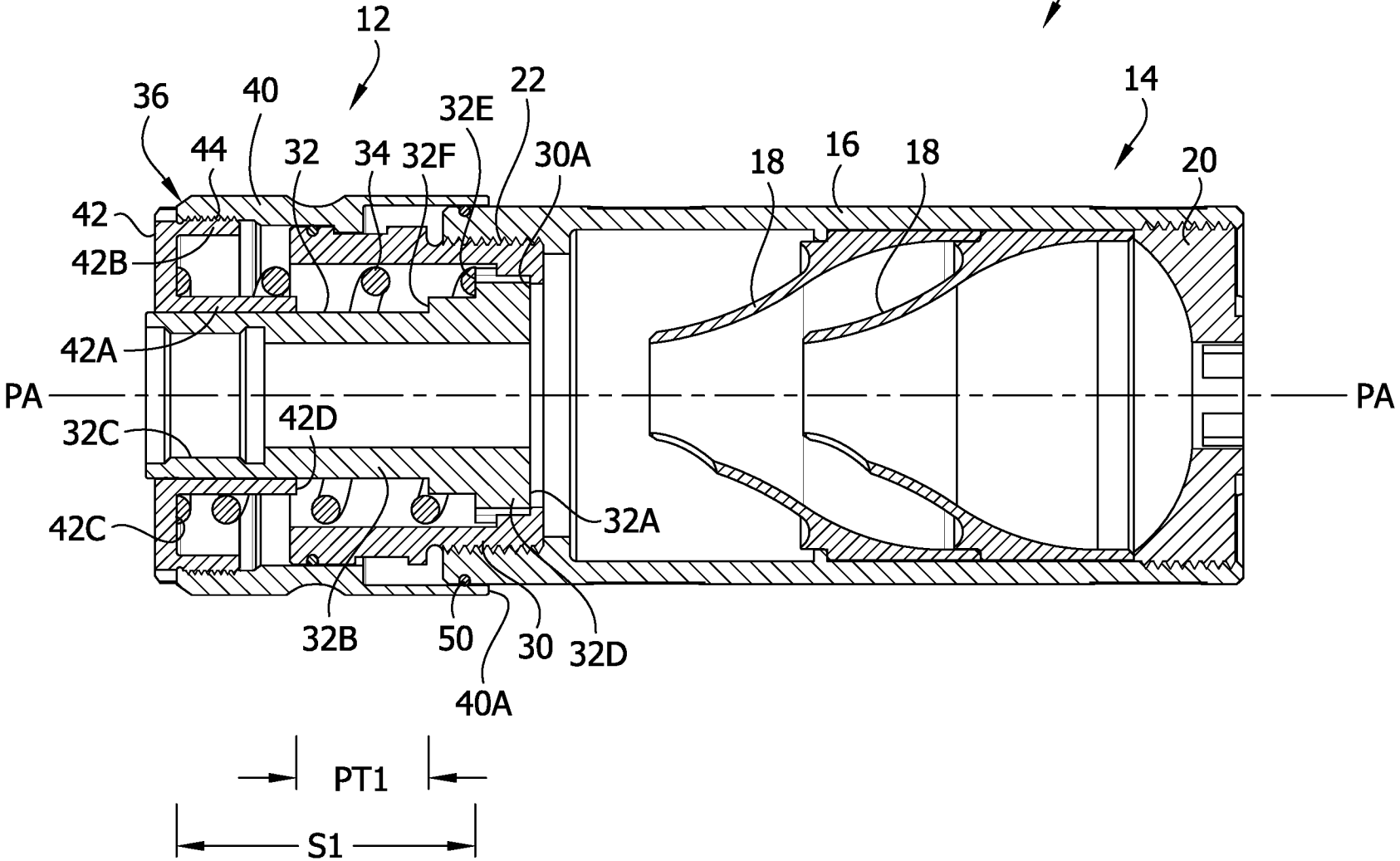
FIG. 2 is a section of the assembly taken in a plane including line 2-2 of FIG. 1.

Referring to FIG. 2, the assembly 10 has a proximal end defined by the inertial decoupler 12 to which the firearm is connectable, and the assembly has a distal end defined by the sound suppressor 14 out of which a projectile fired by the firearm would exit the assembly. In the illustrated embodiment, the inertial decoupler 12 is releasably connected to the sound suppressor 14 such that the inertial decoupler could be removed from the sound suppressor (e.g., for cleaning and/or for use with other sound suppressors or other firearm accessory). In other embodiments, the inertial decoupler or components thereof could be integrated with or formed integrally with the sound suppressor (e.g., integrated housing) such that the inertial decoupler is dedicated to the sound suppressor.

The sound suppressor 14 includes a suppressor housing 16 defining an interior that houses a plurality of baffles 18 (e.g., at least two baffles). The sound suppressor has a proximal end connected to the inertial decoupler 12 and a distal end opposite the proximal end that is closed by an end cap 20 threaded to the housing 16. The suppressor housing 16 is internally threaded at its proximal end for forming a threaded connection 22 with the inertial decoupler 12. The sound suppressor 14 defines a projectile passage along which a projectile fired from a firearm can pass down a projectile axis PA when the suppressor is mounted on the firearm. The suppressor housing 16, baffles 18, and end cap 20 form a tortuous gas flow path to reduce sound emitted after the firearm is fired. It will be appreciated that the sound suppressor 14 is shown by way of example without limitation. Other types and configurations of sound suppressors (e.g., different types and numbers of baffles (e.g., one baffle) and/or housings, etc.) can be used without departing from the scope of the present disclosure.

The inertial decoupler 12 includes a housing 30, a piston 32, a spring 34, and a spring retainer 36. The piston 32 is connectable to the firearm and is biased distally by the spring 34 to an at-rest position in the housing 30 (e.g., FIGS. 2, 10-12). Responsive to firing of the firearm, the piston 32 is movable against the bias of the spring 34 to deflect the spring such that the piston is permitted to travel with the barrel to temporarily "decouple" the mass of the sound suppressor 14 from the barrel. This permits a firearm such as some types of pistols to properly cycle. As explained in further detail below, the inertial decoupler 12 is adjustable to adjust a preload of the spring 34 (i.e., a deflection of the spring when the piston is in the at-rest position) and/or to adjust a maximum permitted travel distance the piston 32 away from the at-rest position.

Figure 3:
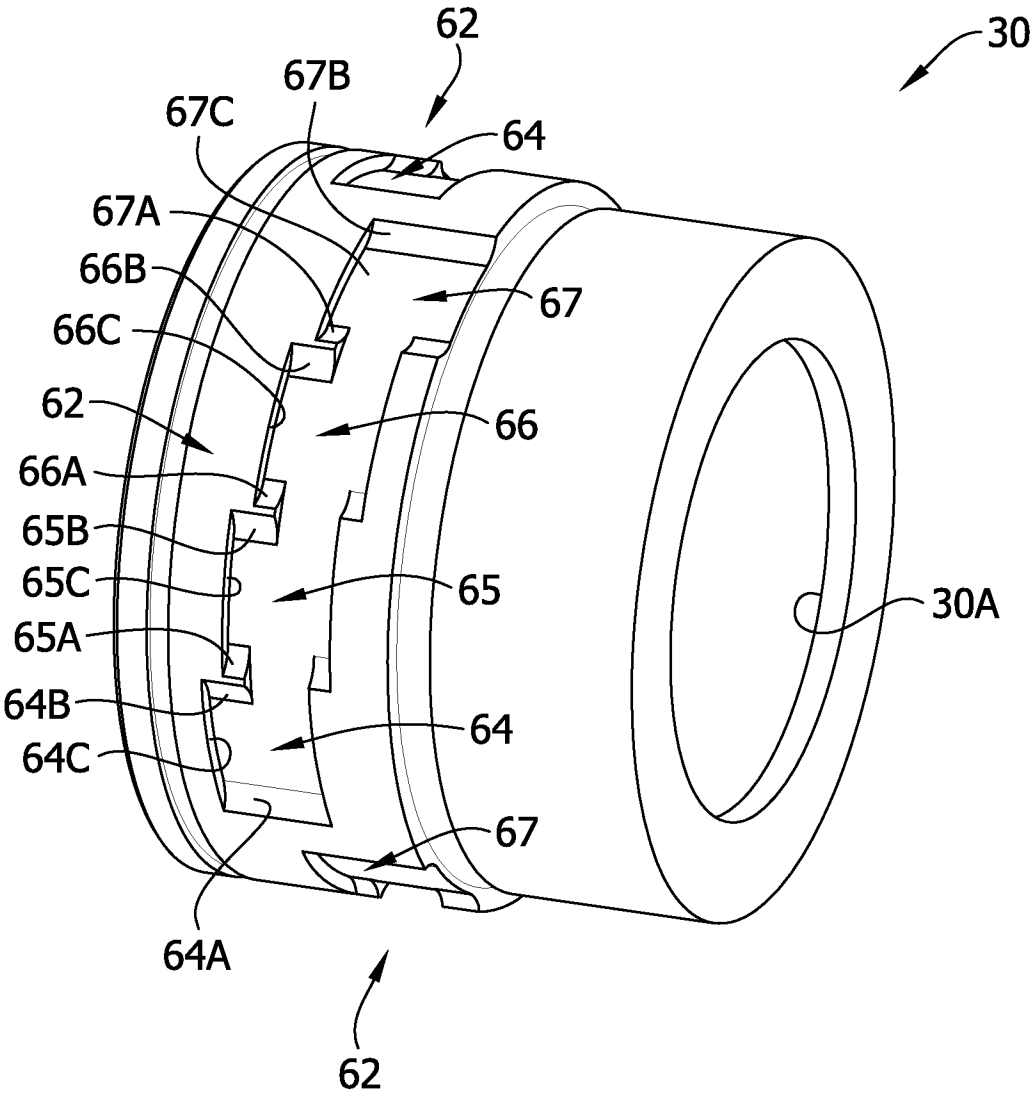
FIG. 3 is a perspective of a housing of the inertial decoupler.
Figure 4:
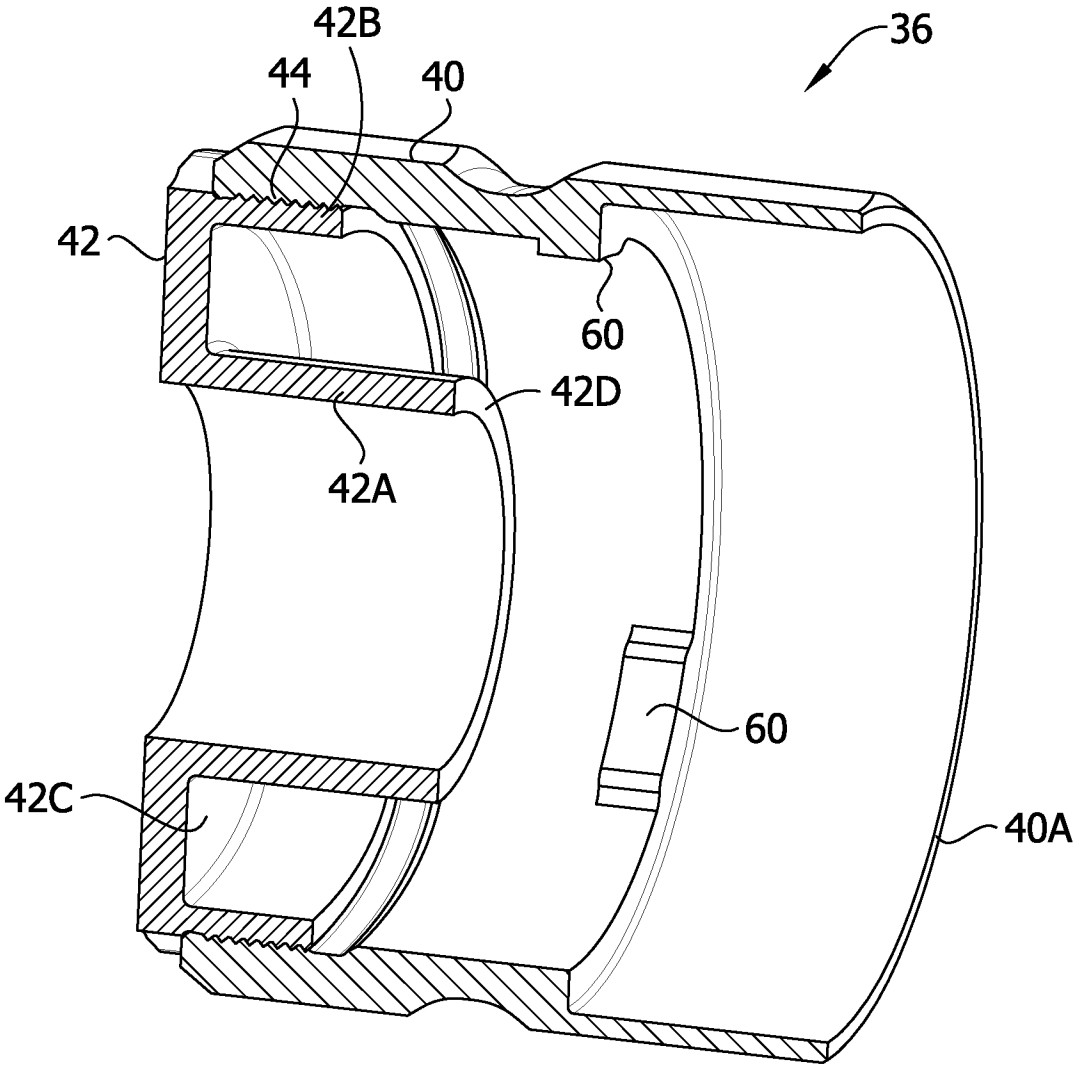
FIG. 4 is a section of a spring retainer of the inertial decoupler taken in a plane including line 2-2 of FIG. 1.

Referring now also to FIGS. 3 and 4, in the illustrated embodiment, the housing 30 comprises a tubular housing body. The housing 30 has a proximal end and a distal end. The housing 30 is sized and shaped to permit a projectile fired from the firearm to pass through the housing from the housing proximal end to the housing distal end when the inertial decoupler 12 is connected to the firearm. The housing 30 has an interior in which the piston 32 and spring 34 are received. The distal end of the housing 30 has a male thread configured for forming the threaded connection 22 with the sound suppressor housing 16. The housing 30 includes a lip protruding inward near the distal end of the housing defining a shoulder 30A. The shoulder can be referred to broadly as a stop and is positioned to engage the piston 32 to locate the piston with respect to the housing 30 in the at-rest position of the piston. The shoulder 30A limits distal movement of the piston 32 beyond the at-rest position. Other types of stops for locating the piston in the at-rest position can be used. For example, the stop could be on a component other than the inertial decoupler housing, and the stop could be located to engage the piston at a location on the piston other than the distal end. It will be appreciated that the housing 16 and housing 30 collectively could be referred to as a housing of the assembly 10.

In the illustrated embodiment, the spring 34 is a compression spring. The spring includes a wire coil having opposite proximal and distal ends. The spring 34 is received over the piston 32 and is located in an interstitial space between the piston and the housing 30. Desirably, in the at-rest position of the piston 32, the spring 34 is in engagement with the spring retainer 36 and piston 32 such that the spring is deflected and exerts a biasing force maintaining the piston in the at-rest position. As explained in further detail below, the deflection of the spring 34 when the piston 32 is in the at-rest position (the spring preload) can be adjusted, which may change the spring force the piston needs to overcome to move proximally, away from the at-rest position.

Figure 5:
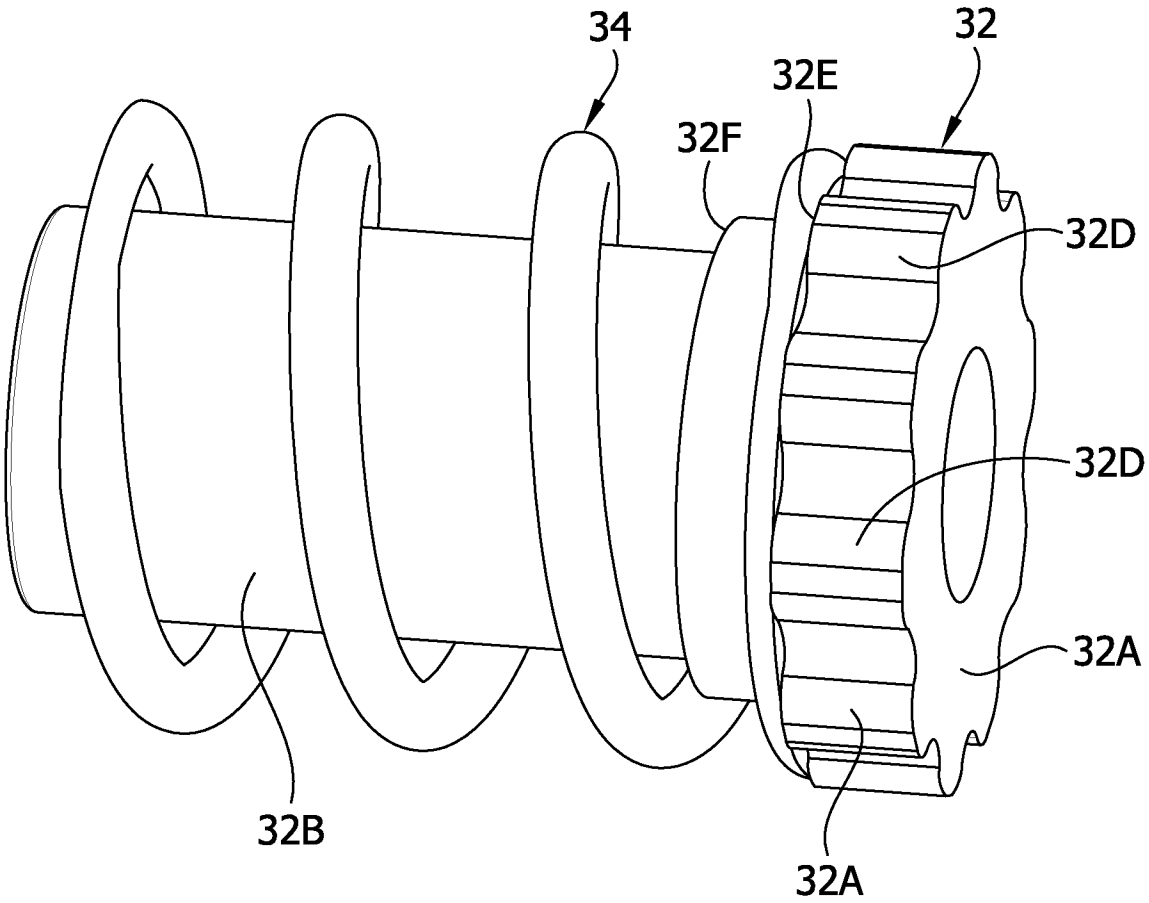
FIG. 5 is a perspective of a piston and spring of the inertial decoupler.

The piston 32 has a head 32A at its distal end that is wider than a neck 32B extending proximally from the head to the proximal end of the piston. (See FIGS. 2 and 5.) The piston 32 defines a projectile passage extending through the piston down which a projectile from the firearm can pass along the projectile axis PA. The piston 32 has a female thread 32C at the proximal end of the piston for connecting to a threaded barrel of a firearm. Other configurations (e.g., quick connections) could be used. The head 32A includes a plurality of ribs 32D extending radially outward with respect to the projectile axis PA. The ribs 32D interface with one or more lugs (not shown) on an inside of the housing 30 to limit rotation of the piston 32 with respect to the housing when the piston is in the at-rest position. This facilitates threading the inertial decoupler 12 onto a firearm because the piston 32 rotates about the projectile axis PA conjointly with the housing 30 and suppressor 14 as the user grips and rotates the assembly 10. Proximal sides 32E of the ribs 32D define respective bearing surfaces against which the distal end of the spring 34 bears to bias the piston 32 toward the at-rest position. The head 32A further includes a shoulder 32F facing proximally that limits travel of the piston 32 proximally against the bias of the spring 34, as explained further below. In other embodiments, the piston may not be limited in travel proximally from the at-rest position other than by full deflection of the spring.

The spring retainer 36 includes a collar 40 (broadly, "adjustment body") and a cap 42 connected to the collar by a threaded connection 44. The cap includes an annular proximal wall and an inner sleeve 42A and outer sleeve 42B extending distally from the proximal wall. The spring 34 is received in the cap 42 between the inner and outer sleeves 42A, 42B. The outer sleeve 42B has a male thread for forming the threaded connection 44 with a female thread of the collar 40. The cap 42 defines a spring engagement surface 42C against which the proximal end of the spring 34 bears to bias the piston 32 distally with respect to the housing 30 and spring retainer 36. The inner sleeve 42A extends distally from the spring engagement surface 42C and terminates in a rim 42D facing distally. The rim 42D can be referred to broadly as a stop located to engage the shoulder 32F of the piston 32 to limit proximal travel of the piston from the at-rest position. Responsive to the firearm being fired, the piston 32 moves proximally from the at-rest position such that the suppressor 14 is temporarily "decoupled" from the firearm, until the shoulder 32F engages the stop 42D. Desirably, the distance PT1 between the shoulder 32F and the stop 42D when the piston 32 is in the at-rest position allows for sufficient piston travel to permit the firearm to cycle properly. This distance PT1 can be adjusted, as explained in further detail below.

The collar 40 includes a tubular collar body that extends from the cap 42 to the suppressor housing 16. The proximal end of the collar 40 has an internal thread configured to make the threaded connection with the cap 42. The distal end of the collar 40 overlies the outer surface of the suppressor housing 16, terminates in a rim 40A, and is slidably engaged with the outer surface of the suppressor housing. A seal in the form of an O-ring 50 seated in an annular groove in the suppressor housing 16 is provided to resist entry of contaminants into the inertial decoupler 12 between the collar 40 and the suppressor housing.

The spring retainer 36 is configurable in several preset positions with respect to the housing 30 and piston 32 to change a distance S1 between the spring engagement surfaces 32E, 42C, and the distance PT1 between the piston shoulder 32F and the stop 42D, when the piston 32 is in the at-rest position. In the illustrated embodiment, the spring retainer 36 is movable to four preset positions. As shown in FIG. 1, four indicators 52A-52D are provided on the outside of the housing 16 to indicate the current position of the spring retainer 36. The indicators 52A-52D are used in conjunction with the distal rim 40A of the collar. The distal rim 40A acts as a reference with respect to the indicators 52A-52D. Whichever indicator 52A-52D the rim 40A is closest to or overlies is the indicator corresponding to the current position of the spring retainer 36. The indicators include lines extending circumferentially of the housing 16 to indicate to a user when the spring retainer is in a preset position. Optionally, labels 54A-54D (e.g., icons, numbers, letters, etc.) can be provided to associate respective indicators 52A-52D with a spring preload and/or permitted piston travel when the spring retainer is in the associated position.

The inertial decoupler 12 includes retaining structure configured to selectively retain the spring retainer 36 in the first preset position and the second preset position. The retaining structure includes first connection structure and second connection structure configured to engage the first connection structure to retain the spring retainer in the preset positions. In the illustrated embodiment, the collar 40 includes the first connection structure, which includes three lugs 60, two of which may be seen in FIG. 4. The lugs 60 each protrude inward from an inner surface of and are spaced circumferentially around a tubular body of the collar. The housing 30 includes the second connection structure, which includes three separate lug tracks 62 (broadly, "lug retainers") each extending partially around the projectile axis PA on an outer surface of and spaced circumferentially around the tubular housing body. It will be appreciated that one or more of the lugs 60 could be on the housing 30 rather than the collar 40, and one or more of the lug tracks 62 could be on the collar instead of the housing (i.e., some or all of the first and second connection structure could be in other locations), without departing from the scope of the present disclosure. Moreover, other types of connection structure, and/or other numbers of connection structure elements (e.g., lugs, lug tracks, etc.) could be used.

The lug tracks 62 include a plurality of lug seats 64-67 to which the lugs 60 are movable to change the position of the spring retainer 36 with respect to the housing 30 and piston 32. In each of the preset positions, each lug 60 is engaged with an associated lug seat 64-67 in its respective lug track 62. The lugs 60 move conjointly along their respective lug tracks 62 to change among the preset positions of the spring retainer 36. Each lug seat 64-67 is defined by a slot extending along the outer surface of the housing 30 and generally parallel with the projectile axis PA. The slots each include opposite side walls 64A, 64B, 65A, 65B, 66A, 66B, 67A, 67B and a proximal wall 64C, 65C, 66C, 67C against which the lugs 60 bear in in opposition of the spring bias when the lugs are engaged with the seats 64-67. The side walls 64A, 64B, 65A, 65B, 66A, 66B, 67A, 67B obstruct the lugs 60 to limit rotation of the spring retainer 36 about the projectile axis PA with respect to the housing 30 when the lugs 60 are engaged with the lug seats 64-67. The lugs 60 are maintained in engagement with the seats 64-67 by the spring 34 biasing the spring retainer 36 proximally. The spring retainer 36 can be referred to as "locked" in a preset position when the lugs 60 are engaged with a set of the seats 64-67 and the spring 34 is biasing the lugs to maintain them in the seats.

To change the preset position of the spring retainer 36, a user can disengage all of the lugs 60 conjointly from a set of lug seats 64-67 by grasping the suppressor housing 16 with one hand, grasping the spring retainer with another hand, and pushing the spring retainer to deflect the spring 34. This "unlocks" the spring retainer 36 and permits the spring retainer to be rotated about the projectile axis PA to relocate the lugs 60 to a different set of lug seats 64-67. It will be appreciated that the lug track 62 is stepped such that, depending on the lug seats 64-67 to which the lugs 60 are to be moved, the user may need to use a combination of rotation and axial movement (either proximally or distally) of the spring retainer 36. When the lugs 60 are located in axial alignment with the desired set of lug seats 64-67, the user can permit the spring 34 to push the spring retainer 36 proximally to engage the lugs with the lug seats (slide proximally into the slots defining the lug seats), thus locking the spring retainer in that preset position of the spring retainer.

Figure 6:
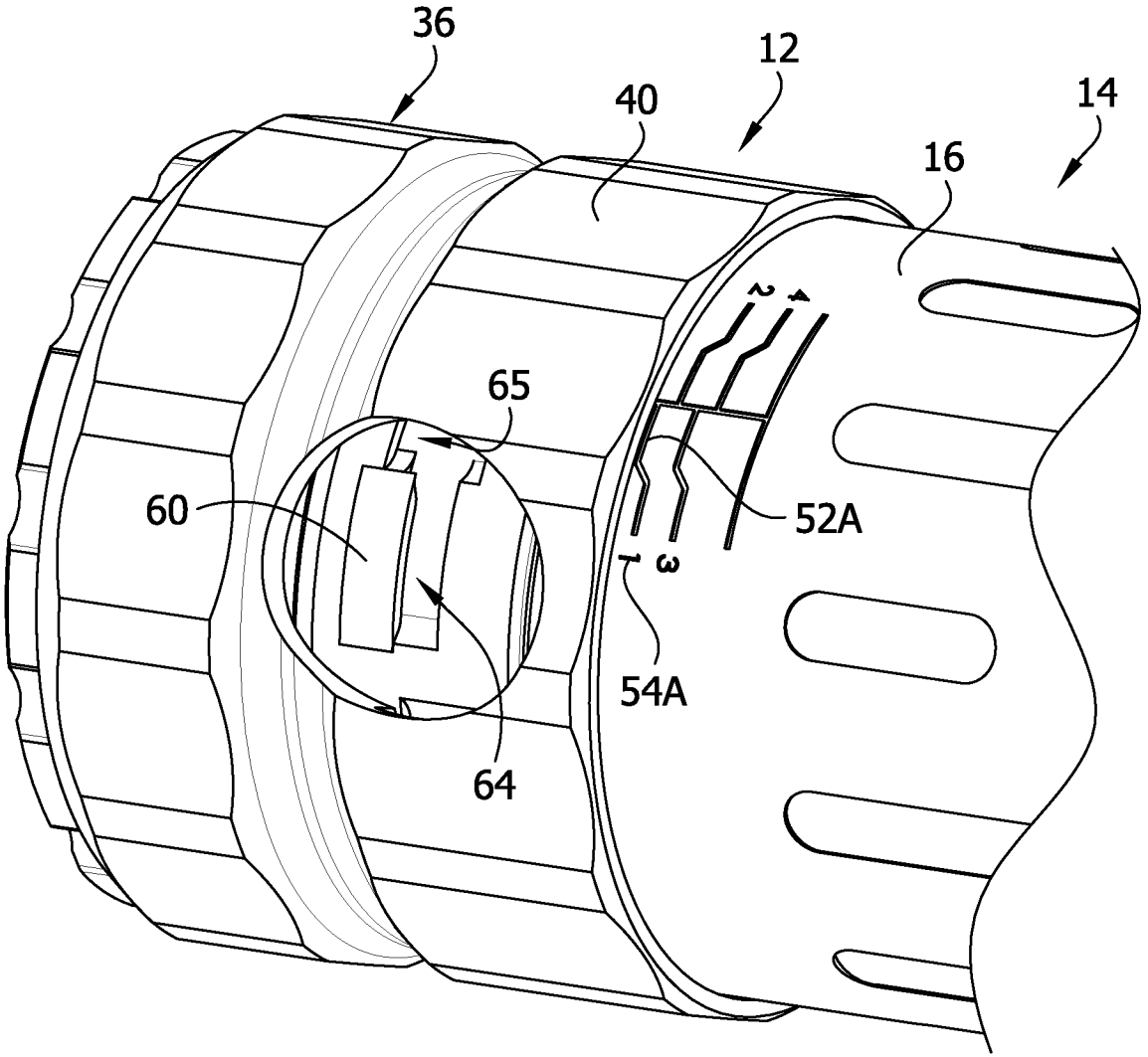
FIG. 6 is a fragmentary perspective of the assembly in which a portion of the spring retainer is broken away to show a lug engaged with a first lug seat of the housing.
Figure 7:
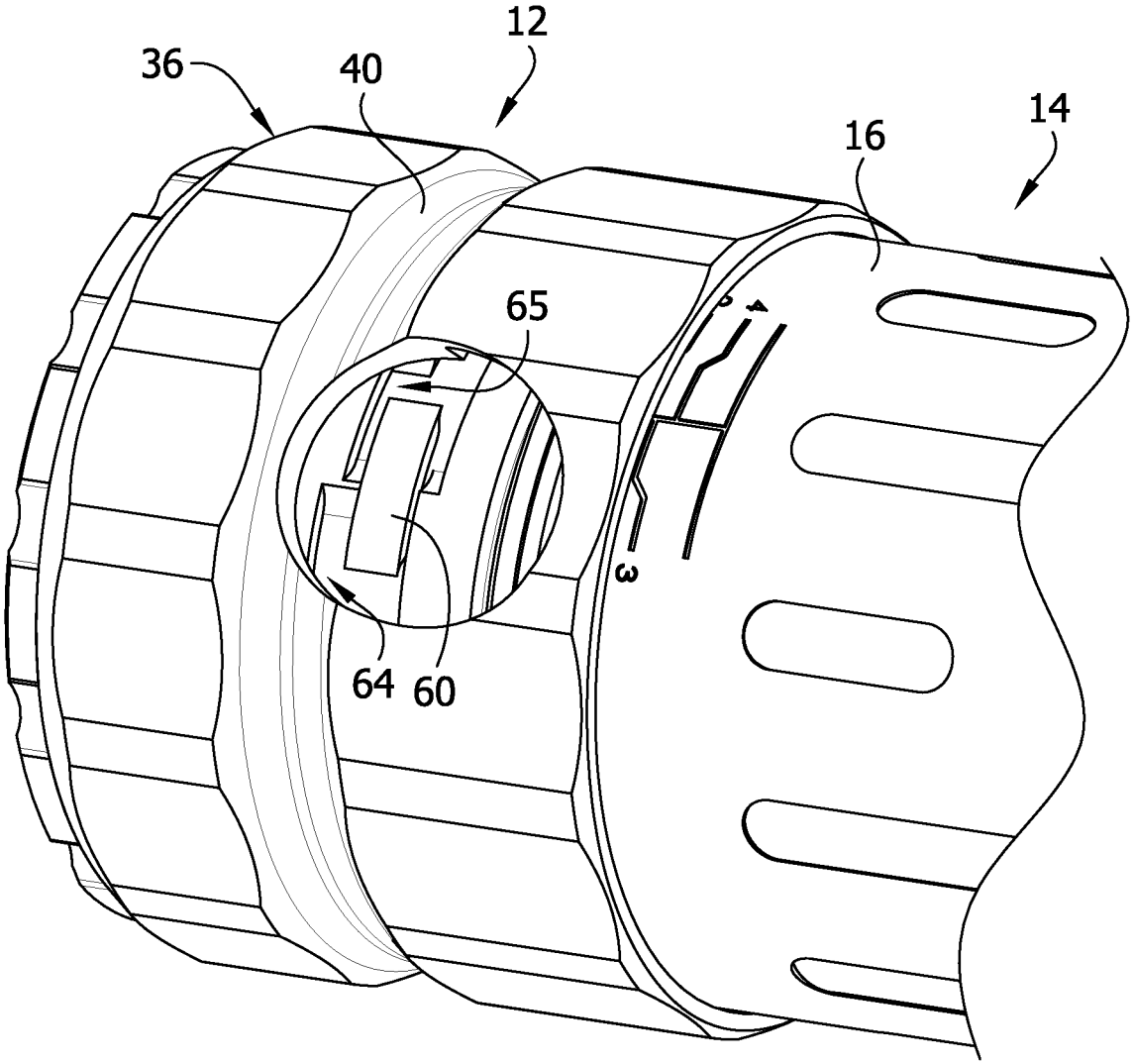
FIG. 7 is a view similar to FIG. 6 but showing the lug disengaged from the first lug seat and the spring retainer rotated to move the lug toward a second lug seat.
Figure 8:
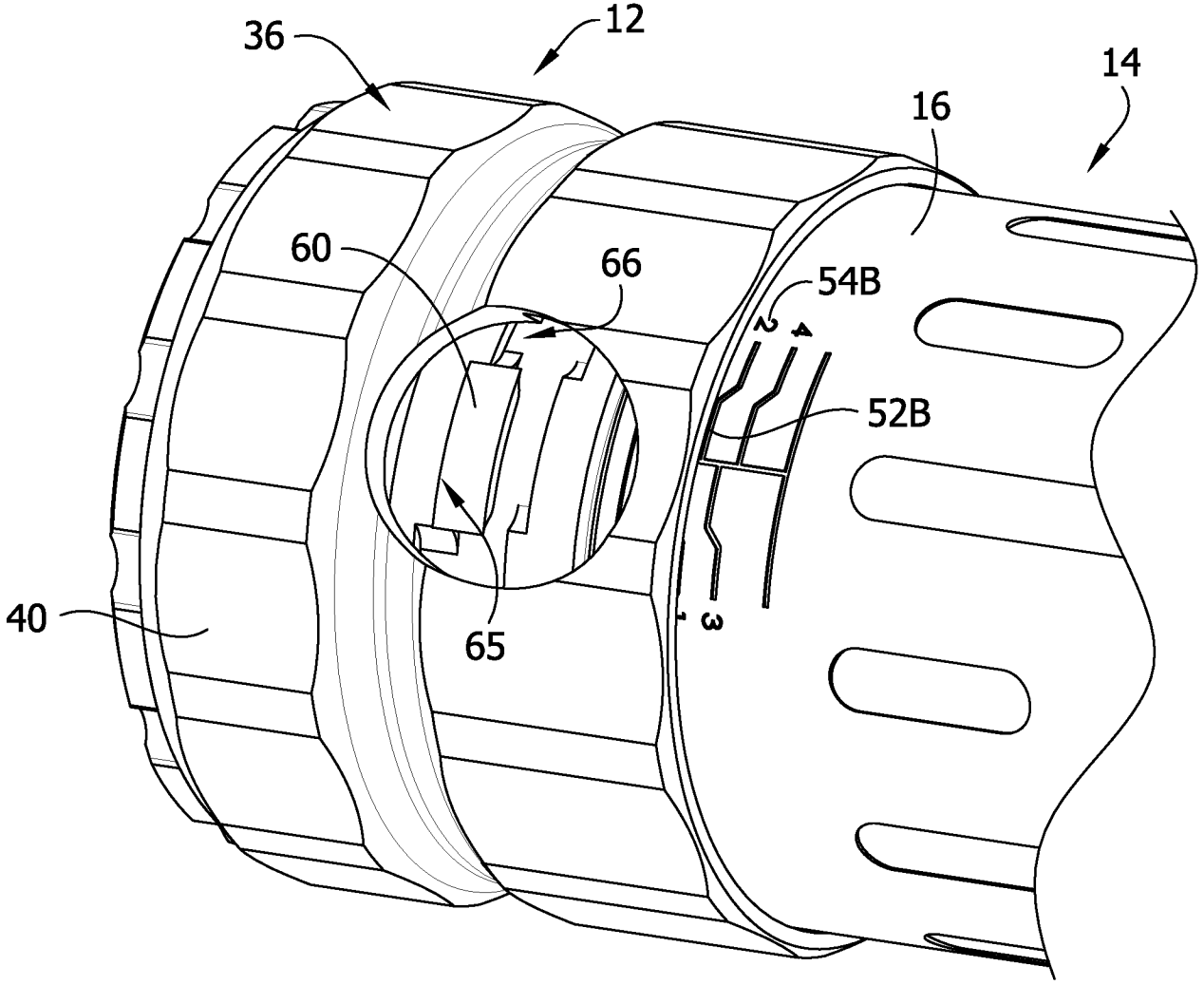
FIG. 8 is a view similar to FIG. 7 but showing the lug engaged with the second lug seat.
Figure 9:
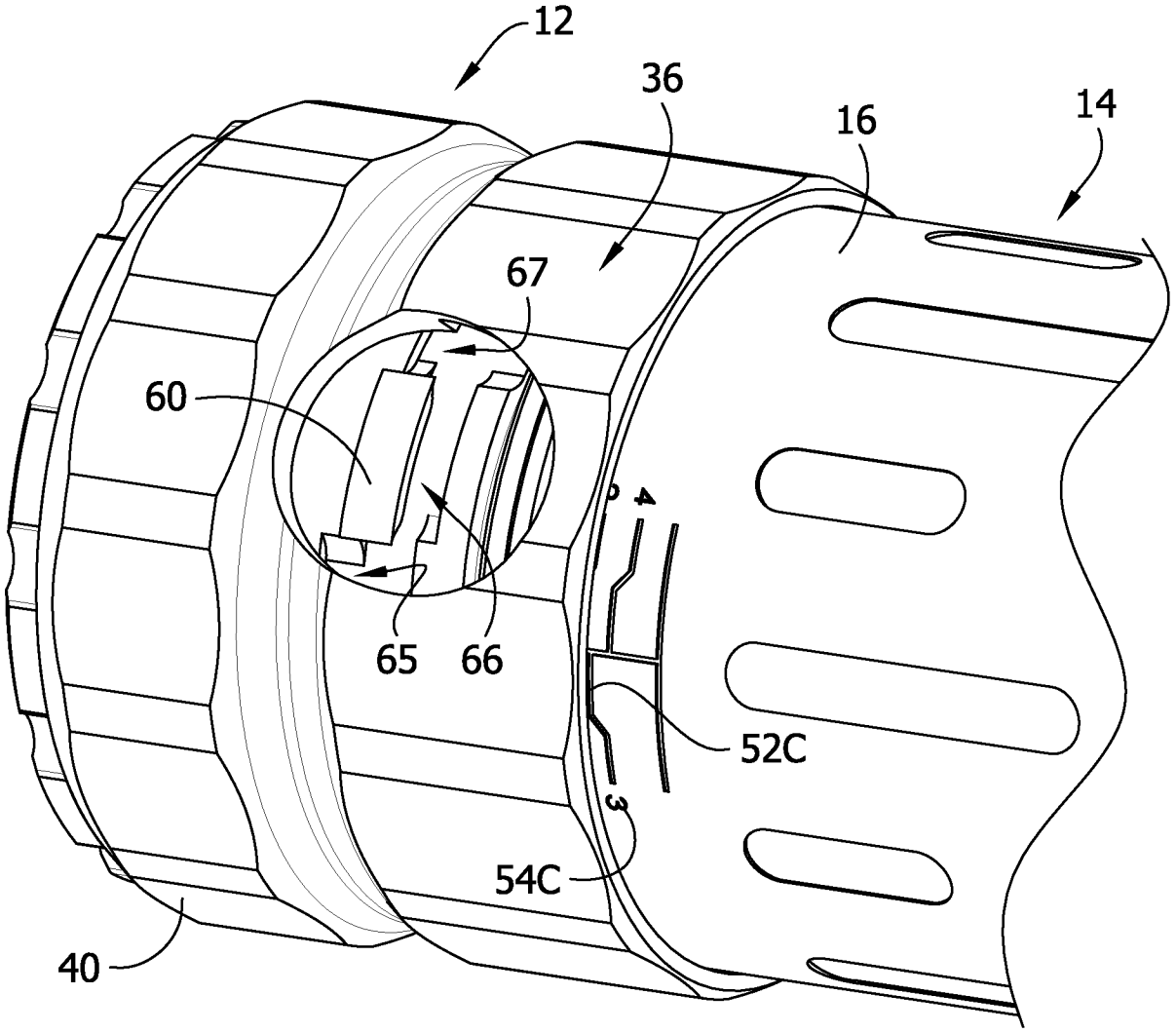
FIG. 9 is a view similar to FIG. 8 but showing the lug retainer engaged with a third lug seat.

An example sequence of moving the spring retainer 36 to reposition the lugs 60 from a first lug seat 64 to a second lug seat 65 is shown in FIGS. 6-9, in which a circular portion of the collar 40 is broken away to expose one of the lugs 60. In FIG. 6, the lug 60 is shown in the lug seat 64. In FIG. 7, the spring retainer 36 has been pushed distally to compress the spring 34 to move the lug out of engagement with the lug seat 64, and the spring retainer has been rotated to move the lug toward registration with the lug seat 65. In FIG. 8, the spring retainer 36 has been further rotated about the projectile axis PA to position the lug 60 in registration with the lug seat 65, and the spring 34 has been permitted to move the lug proximally into engagement with the lug seat 65. In FIG. 9, the spring retainer 36 has been moved to position the lug 60 in engagement with the lug seat 66.

Figure 10:
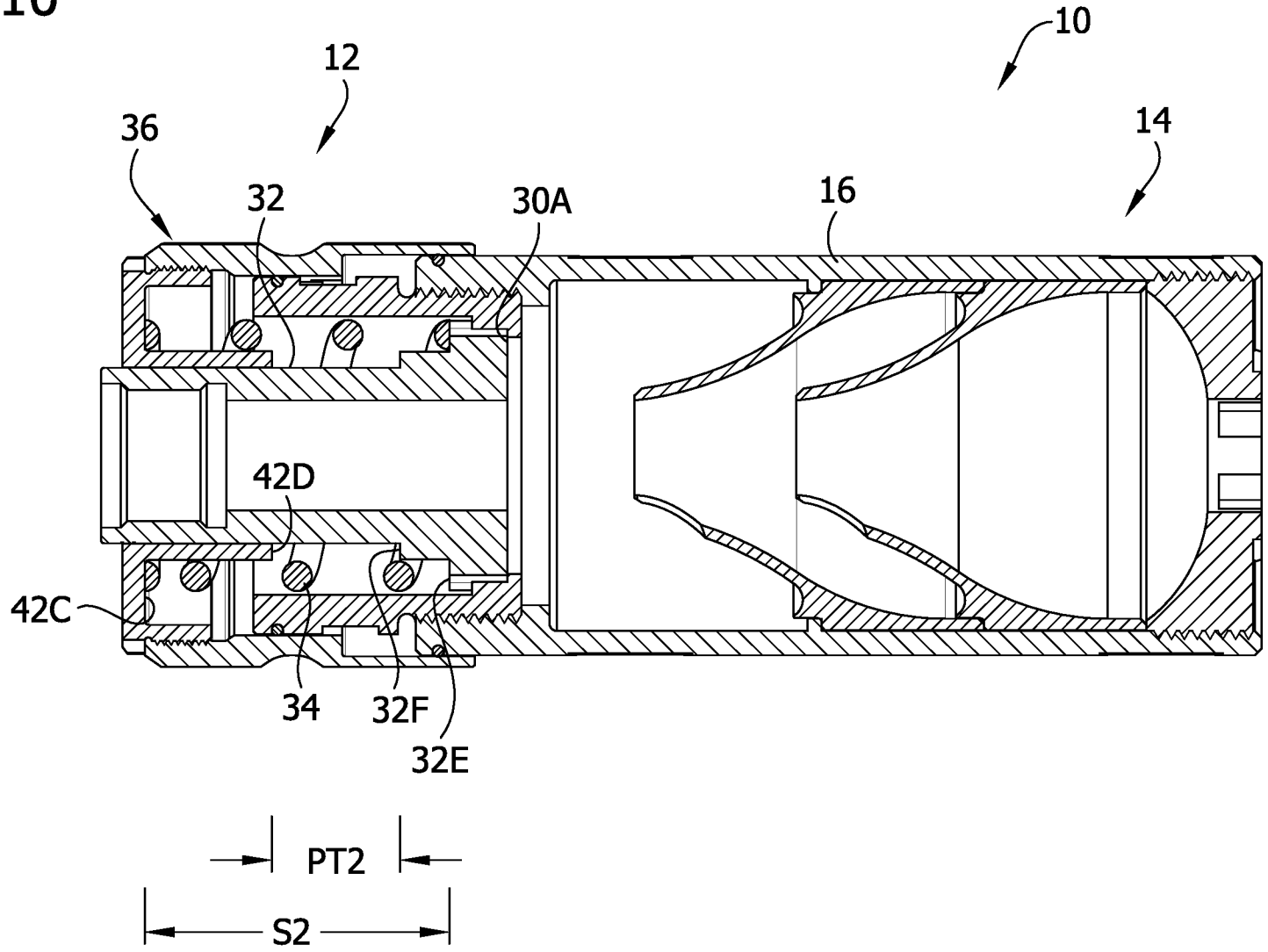
FIG. 10 is a section similar to FIG. 2 but showing the inertial decoupler adjusted to a second preset configuration.
Figure 11:
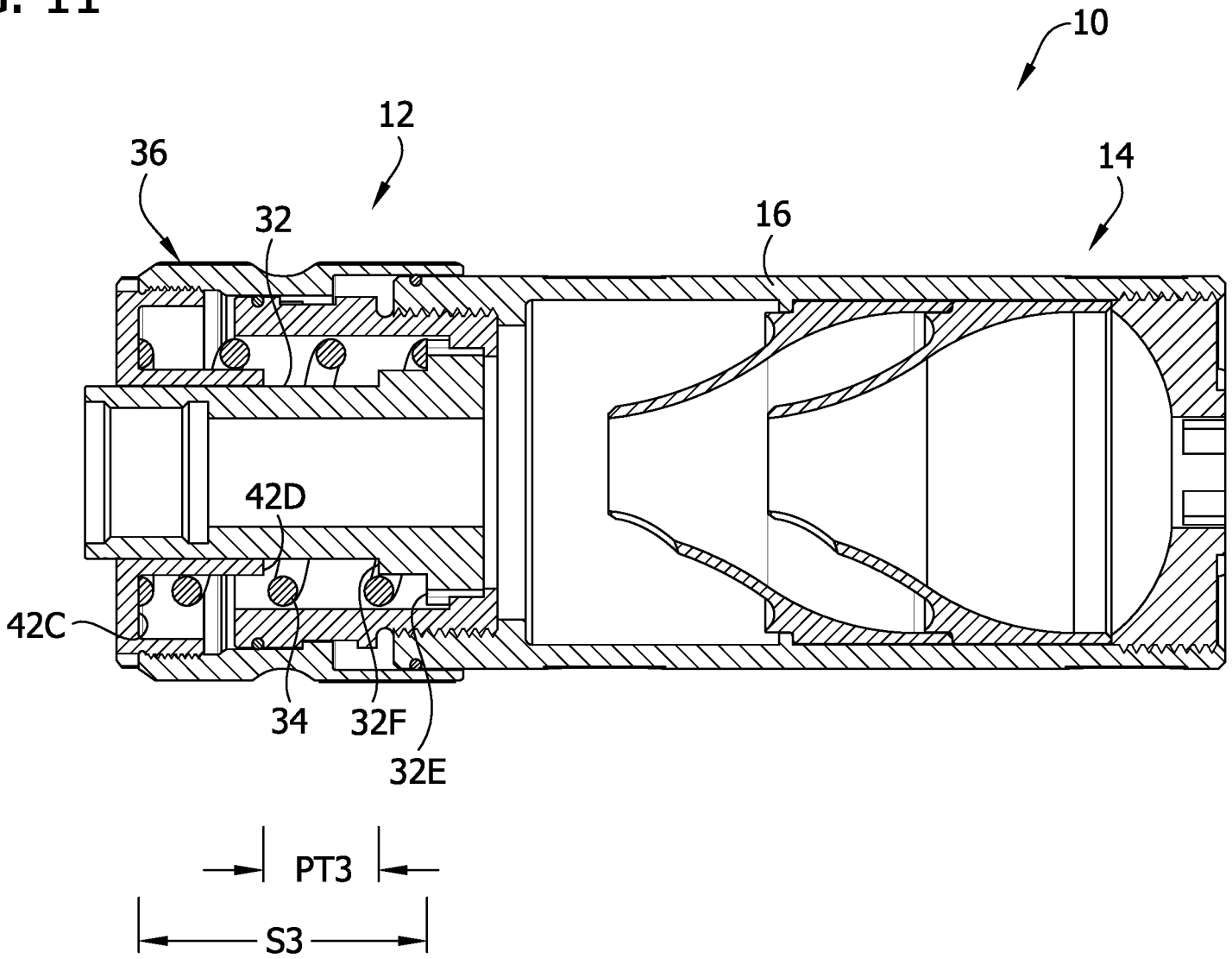
FIG. 11 is a section similar to FIG. 10 but showing the inertial decoupler adjusted to a third preset configuration.
Figure 12:
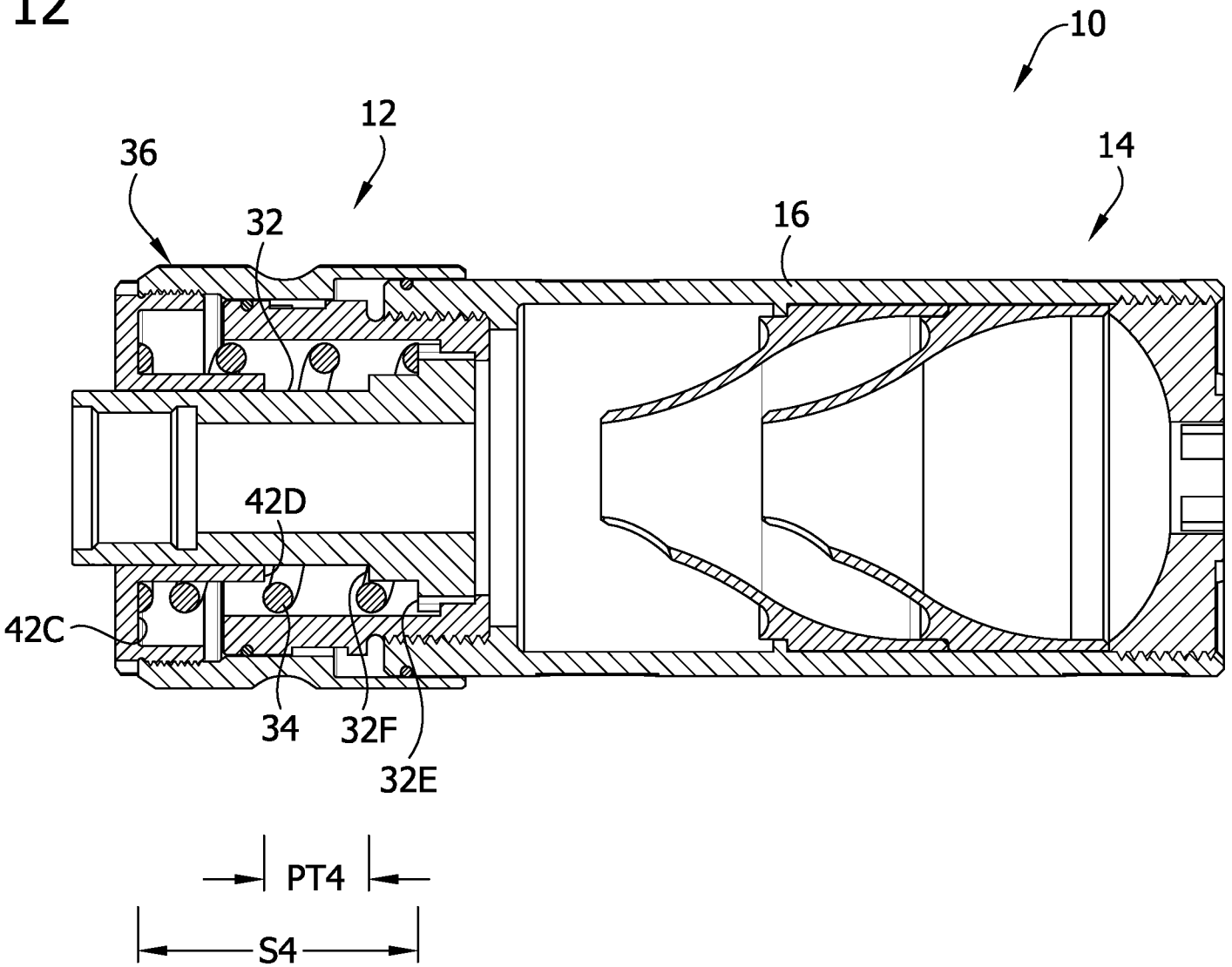
FIG. 12 is a section similar to FIG. 11 but showing the inertial decoupler adjusted to a fourth preset configuration.

A comparison of FIGS. 2 and 10-12 illustrates the difference in spring preload and the difference in permitted piston travel among the four preset positions of the spring retainer 36. In FIGS. 1 and 2, the lugs 60 are engaged with the lug seats 64, such that the spring retainer 36 is in a first preset position (corresponding to indicator 52A and label 54A) providing the least amount of spring preload (spring undeflected length minus S1, or deflection of the spring in the at-rest position of the piston) and permitting the most amount of piston travel PT1. In FIG. 10, the lugs 60 are engaged with the lug seats 65, such that the spring retainer 36 is in a second preset position (corresponding to indicator 52B and label 54B) providing the second-least amount of spring preload (spring undeflected length minus S2) and permitting the second-most amount of piston travel PT2. In FIG. 11, the lugs 60 are engaged with the lug seats 66, such that the spring retainer 36 is in a third preset position (corresponding to indicator 52C and label 54C) providing the second-most amount of spring preload (spring undeflected length minus S3) and permitting the second-least amount of piston travel PT3. Finally, in FIG. 12, the lugs 60 are engaged with the lug seats 67, such that the spring retainer 36 is in a fourth preset position (corresponding to indicator 52D and label 54D) providing the most amount of spring preload (spring undeflected length minus S4) and permitting the least amount of piston travel PT4. The axial distance between two lug seats (e.g., 64 and 65) is the difference in permitted piston travel (PT1 minus PT2) and is the difference in at-rest spring deflection (e.g., S1 minus S2). In the illustrated embodiment, the axial distance between lug seats 64-67 is the same for all adjacent pairs of lug seats. In other words, the incremental change in permitted piston travel and spring preload is the same if changing between any immediately adjacent lug seats. It will be appreciated that in other embodiments, the incremental change can be different among different pairs of immediately adjacent lug seats. Moreover, the number of lug seats can be other than described herein.

It will be appreciated that other types of retaining structure (e.g., other than lugs and lug tracks or lug seats, etc.) could be used without departing from the scope of the present disclosure. For example, the retaining structure could include a male thread and a female thread forming a threaded connection. In such an example, the preset positions of the spring retainer can be preset by indicators (e.g., on the suppressor housing, inertial decoupler housing, spring retainer, etc.) indicating positions to which the spring retainer can be moved with respect to other structure. A reference such as an edge (or other portion) of, or an indicator on, a structure (e.g., suppressor housing, inertial decoupler housing, spring retainer, etc.) could be used in conjunction with the preset position indicators to indicate to a user when the spring retainer is in the respective preset positions. For example, clocking marks could be provided on the inertial decoupler housing and/or the suppressor housing, and a reference mark on the spring retainer could be used in reference to the clocking marks to locate the spring retainer in preset positions. Accordingly, the indicators would define the preset positions of the spring retainer. It will be appreciated that in the embodiment disclosed herein, the connection structure 60, 62 and the indicators 54A-54D define the preset positions of the spring retainer 36, and in other embodiments connection structure or indicators could define the preset positions of the spring retainer. In some embodiments, the preset positions of the spring retainer could be defined by connection structure, and indicators indicating the preset positions could be omitted.

In a method of using the assembly, a firearm is selected for use with the assembly. For example, a specific pistol may be selected. Based on the characteristics of the pistol, the user may adjust an inertial decoupling characteristic (e.g., spring preload and/or permitted piston travel distance) to provide an inertial decoupling performance for the specific pistol. To adjust the inertial decoupler, the user could reference instructions explaining the spring preloads and/or permitted piston travel associated with the different indicators 52A-52D and labels 54A-54D, and select a preset position of the spring retainer 36 based on the desired spring preload and/or permitted piston travel. For example, the user may manipulate the spring retainer to disengage the lugs from the lug seats 64 and move them to the lug seats 66.

It will be appreciated that different suppressors, pistols, and ammunitions function differently, and a single spring without adjustment may not allow all pistols to function for a given suppressor/pistol/ammunition system. By adjusting the preload of the spring and/or permitted piston travel (amount the pistol barrel moves before it encounters the mass of the suppressor) the adjustable decoupler can be customized to meet user preferences (e.g., feel) and/or to match a suppressor to the requirements of a particular pistol (e.g., based on recoil characteristics, such as unlocking distance of a locked breech, needed to cycle the pistol). The user can adjust the settings on the decoupler to increase/decrease the preload of the spring and/or the permitted travel distance of the piston relative to the suppressor. The decoupler is universal in that it is usable with various suppressors (suppressors having different masses) and with various pistols (having different recoil characteristics).

In testing of a prototype of the illustrated decoupler and suppressor assembly, it was found that adjustment in permitted piston travel distance is particularly useful. This is because some pistols unlock at different positions as the pistol recoils. The unlocking distance of a locked breech pistol is relevant to adjustment of the decoupler. It is desirable to adjust the decoupler to permit piston travel greater than the unlocking distance.

It will be apparent that modifications and variations are possible without departing from the scope of the appended claims. As various changes could be made in the above constructions and methods without departing from the scope of the invention, it is intended that all matter contained in the above description and shown in the accompanying drawings shall be interpreted as illustrative and not in a limiting sense.

What is claimed is:

1. An inertial decoupler for connecting a firearm sound suppressor to a firearm, the inertial decoupler comprising:

a housing having a housing proximal end and a housing distal end, the housing sized and shaped to permit a projectile fired from the firearm along a shooting axis to pass the housing from the housing proximal end to the housing distal end when the inertial decoupler is connected to the firearm, a spring supported by the housing, a piston supported by the housing, the piston including a piston proximal end and a piston distal end, the piston defining a piston passage configured to permit a projectile fired from the firearm to pass from the piston proximal end to the piston distal end along a projectile axis along the piston passage when the inertial decoupler is connected to the firearm, the piston biased distally by the spring toward an at-rest position of the piston with respect to the housing, the piston defining a first spring engagement surface against which the spring bears to bias the piston toward the at-rest position, the piston being movable proximally with respect to the housing away from the at-rest position to deflect the spring responsive to firing of the firearm for temporarily decoupling the firearm sound suppressor from the firearm, a spring retainer engaged with the housing and free of threaded connection with the housing, the spring retainer defining a second spring engagement surface against which the spring bears to bias the piston distally with respect to the housing, the spring retainer being configurable in a first preset position with respect to the piston and a second preset position with respect to the piston to change a distance between the first and second spring engagement surfaces when the piston is in the at-rest position, wherein when the spring retainer is in the first preset position and the piston is in the at-rest position the spring has a first spring preload, and wherein when the spring retainer is in the second preset position and the piston is in the at-rest position the spring has a second spring preload different than the first spring preload.

2. An inertial decoupler as set forth in claim 1, wherein the housing includes a stop configured to limit distal movement of the piston with respect to the housing in the at-rest position to locate the piston with respect to the housing in the at-rest position.

3. An inertial decoupler as set forth in claim 2, wherein the stop is arranged to engage the piston in the at-rest position to locate the piston with respect to the housing.

4. An inertial decoupler as set forth in claim 1, further comprising a first indicator arranged to indicate that the spring retainer is in the first preset position.

5. An inertial decoupler as set forth in claim 4, wherein the first indicator is on the housing.

6. An inertial decoupler as set forth in claim 5, wherein the spring retainer includes a reference positionable with respect to the first indicator to indicate the spring retainer is in the first preset position.

7. An inertial decoupler as set forth in claim 4, further comprising a second indicator arranged to indicate the spring retainer is in the second preset spring retainer position.

8. An inertial decoupler as set forth in claim 1, further comprising retaining structure configured to selectively retain the spring retainer in the first preset position and the second preset position.

9. An inertial decoupler as set forth in claim 8, wherein the retaining structure comprises first connection structure and second connection structure, the first connection structure configured to engage the second connection structure to retain the spring retainer in the first preset position and the second preset position.

10. An inertial decoupler as set forth in claim 9, wherein the spring retainer comprises the first connection structure and the housing comprises the second connection structure.

11. An inertial decoupler as set forth in claim 9, wherein the first connection structure comprises at least one of a lug or a lug retainer, the second connection structure comprising the other of the at least one of the lug or the lug retainer, the lug retainer defining a first lug seat and a second lug seat, the lug being selectively movable with respect to the lug retainer to engage the lug with the first lug seat or to engage the lug with the second lug seat, the spring retainer being in the first preset position when the lug is engaged with the first lug seat, and the spring retainer being in the second preset position when the lug is engaged with the second lug seat.

12. An inertial decoupler as set forth in claim 11, wherein the first and second lug seats are configured to obstruct movement of the at least one lug when in engagement therewith to limit rotation of the spring retainer about the projectile axis.

13. An inertial decoupler as set forth in claim 12, wherein the at least one lug retainer comprises a lug track along which the at least one lug is movable to selectively engage the lug with the first lug seat or the second lug seat, the spring retainer being rotatable about the projectile axis to move the lug in the lug track to move the lug between the first lug seat and the second lug seat.

14. An inertial decoupler as set forth in claim 13, wherein the at least one lug retainer comprises a first lug retainer and a second lug retainer, and wherein the at least one lug comprises a first lug and a second lug, the first lug being selectively engagable with the first lug seat or the second lug seat of the first lug retainer, and the second lug being selectively engagable with the first lug seat or the second lug seat of the second lug retainer.

15. An inertial decoupler as set forth in claim 11, wherein the spring retainer comprises the at least one lug.

16. An inertial decoupler as set forth in claim 11, wherein the proximal portion of the piston is configured to connect to the firearm.

17. An inertial decoupler as set forth in claim 11, in combination with the firearm sound suppressor.

18. An inertial decoupler as set forth in claim 17, wherein the firearm sound suppressor includes a suppressor housing releasably connected to the housing of the inertial decoupler.

* * * * *